US006725607B1

(12) United States Patent
Flynn

(10) Patent No.: US 6,725,607 B1
(45) Date of Patent: Apr. 27, 2004

(54) HANDRAIL SAFETY DEVICE AND METHOD

(76) Inventor: Edward J. Flynn, 228 Bedell Ter., West Hempstead, NY (US) 11552

( * ) Notice: Subject to any disclaimer, the term of this patent is extended or adjusted under 35 U.S.C. 154(b) by 59 days.

(21) Appl. No.: 10/139,546

(22) Filed: May 6, 2002

Related U.S. Application Data

(60) Provisional application No. 60/318,135, filed on Sep. 8, 2001.

(51) Int. Cl.[7] ..... E04H 3/04; E01F 9/00

(52) U.S. Cl. ..... 52/33; 52/174

(58) Field of Search ..... 52/174, 741.3, 52/33, 27; 256/1

(56) References Cited

U.S. PATENT DOCUMENTS 3,670,862 A 6/1972 Kito
3,796,410 A * 3/1974 Konstant ..... 256/1
4,367,517 A * 1/1983 Balzer ..... 362/146
5,339,228 A * 8/1994 Baethge et al. ..... 362/146
6,006,889 A 12/1999 Caron
6,129,442 A * 10/2000 Hoefling et al. ..... 362/146
2002/0036121 A1 * 3/2002 Ball et al. ..... 187/391

* cited by examiner

*Primary Examiner*—Brian E. Glessner
*Assistant Examiner*—Kevin McDermott
(74) *Attorney, Agent, or Firm*—Baker & McKenzie

(57) ABSTRACT

A safety device and method for stairs, escalators and moving sidewalks that moves a person sitting or sliding on a handrail onto the steps to avoid accidents. The safety device includes a sloped surface that can be part of an elongated pyramid. The sloped surface is at an angle of between about 30° and about 45° from the direction of the handrail, with 45° being preferred. The safety device is free of sharp edges and is configured to avoid catching on a person's clothing. The safety device may include illumination.

18 Claims, 4 Drawing Sheets

HANDRAIL SAFETY DEVICE AND METHOD

RELATED APPLICATION

This application claims priority under 35 USC §119 (e) of Provisional Application No. 60/318,135, filed Sep. 8, 2001.

FIELD OF THE INVENTION

The present invention relates generally to a safety device and method for handrails and the like, and more particularly a safety device and method for escalator and stair handrails.

BACKGROUND

Sliding down handrails on stairs and escalators occasionally results in accidents where individuals fall off the handrail or crash into others. This can be especially dangerous where falling over the handrail results in a long drop. Accidents may also occur when individuals sit on an escalator handrail instead of standing. This kind of accident is most prevalent when an individual sits on an escalator handrail while there is a wall at their back that does not go the full length of the escalator. Such a person sitting on the handrail might lean back or reach back to push off against a wall that is no longer there and fall as a result. Accordingly, there is a strong need to insure that people do not injure themselves as is described above.

SUMMARY OF THE INVENTION

An aspect of the invention is to provide a method of improving a person's safety including locating a sloped surface vertically higher than a handrail such that a vertical projection of the sloped surface is between a support and the handrail. The sloped surface is at an angle capable of moving a person toward the handrail.

Another aspect of the invention is to provide a safety device including a sloped surface vertically higher than a handrail such that a vertical projection of the sloped surface is between a support and the handrail. The sloped surface is at an angle capable of moving a person toward the handrail.

Another aspect of the invention is to provide a method of improving a person's safety including locating an elongated pyramid having a sloped surface vertically higher than a handrail such that a vertical projection of the sloped surface is between a support and the handrail. The sloped surface is at an angle between about 30° and about 45° from the direction of the handrail.

Another aspect of the invention is to provide a safety device including an elongated pyramid including a sloped surface. The elongated pyramid is vertically higher than a handrail such that a vertical projection of the sloped surface is between a support and the handrail and the sloped surface is at an angle between about 30° and about 45° from the direction of the handrail.

DETAILED DESCRIPTION

Figure 1:
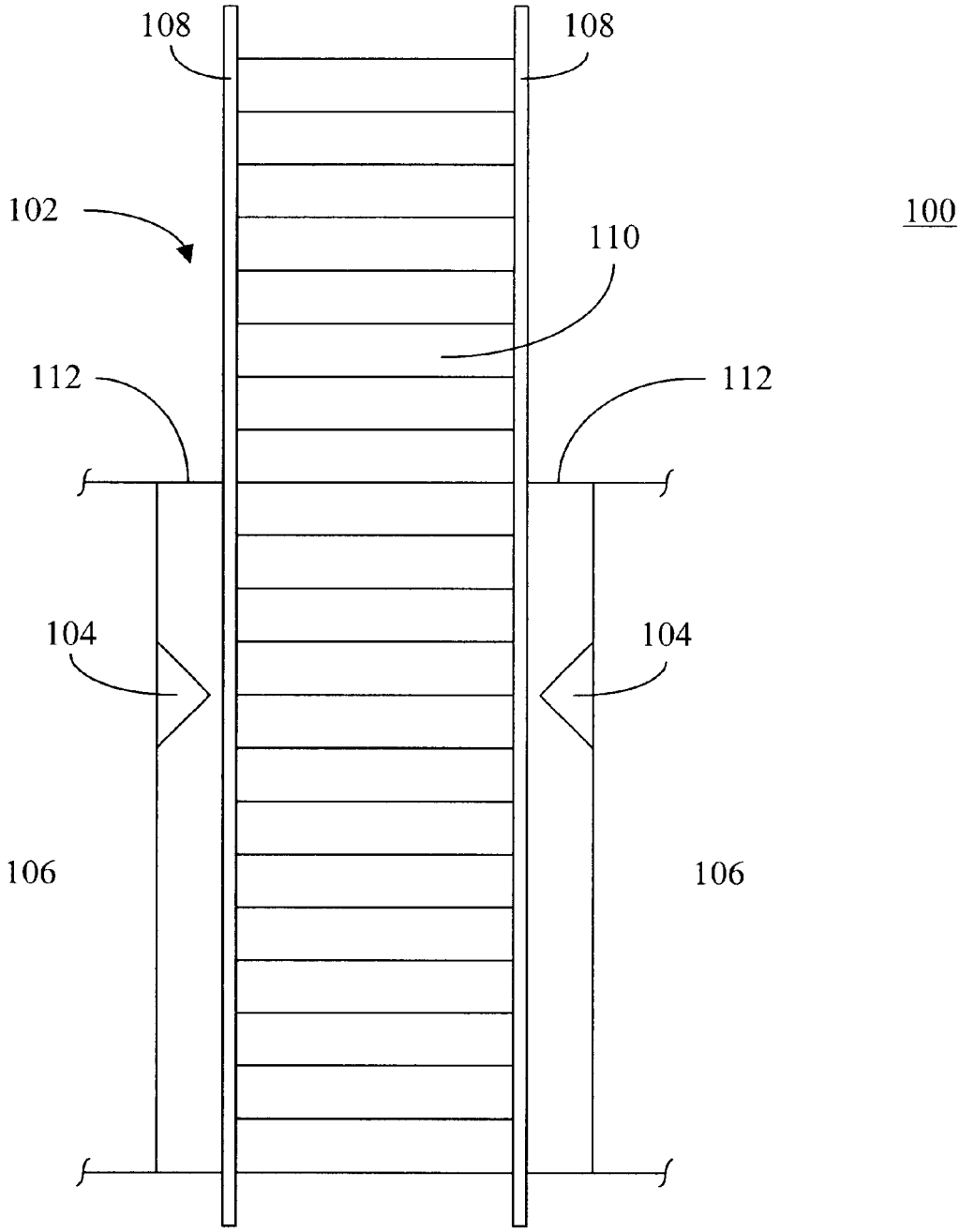
FIG. 1 is a top view of a stair or escalator including safety devices according to the present invention.

The present invention is a safety device that will help return individuals that are sitting or sliding on a handrail to the stairs or escalator by gently moving or bumping such individuals off of the handrail. For example, FIG. 1 is a top view 100 of a stair or escalator 102 including safety devices 104. The safety devices 104 are attached to adjacent walls 106 and extend from the adjacent walls 106 and stop just short of the adjacent handrails 108. The safety devices 104 will gently move or bump any an individual who is sliding or sitting on the handrails 108 back onto the steps 110 of the stair or escalator 102. The safety device 104 should be placed in close proximity (e.g., about 2 feet or 61.0 cm) from away from the end 112 of the wall 106 in order to allow the individual to safely reorient themselves on the steps 110.

Figure 2:
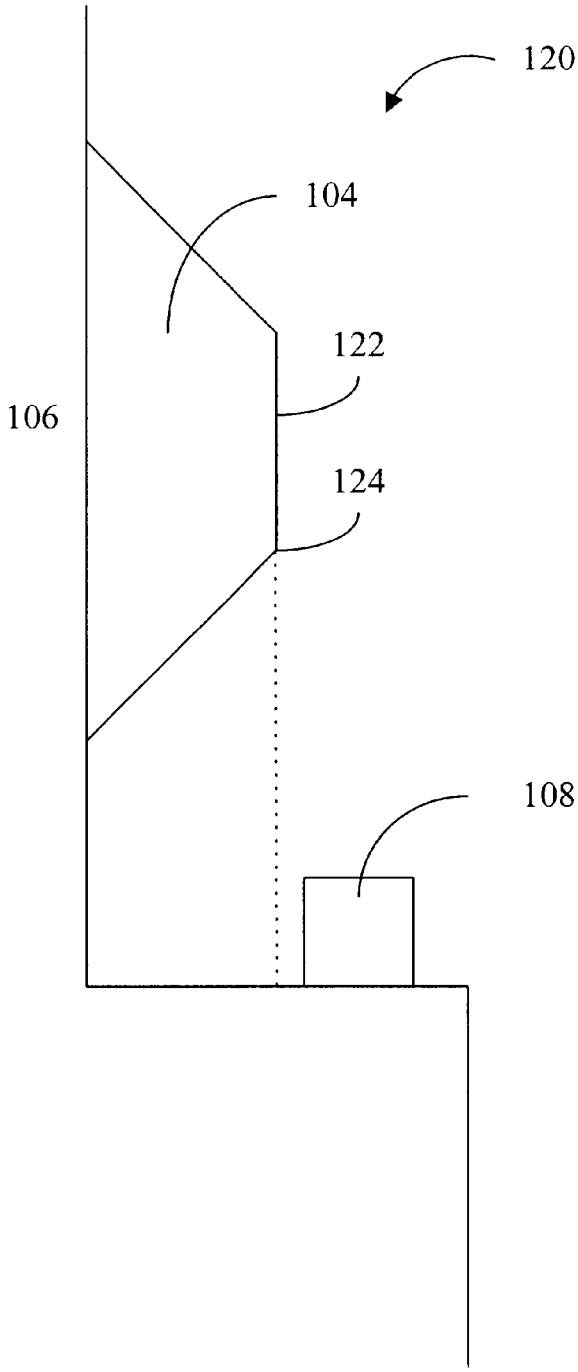
FIG. 2 is a partial side view of FIG. 1.

FIG. 2 is a partial side view 120 of FIG. 1 illustrating the placement of the safety device 104 relative to the handrail 108. As is shown, the apex 122 of the safety device 104 extends to just before (e.g., about 1–2 in. or 2.5–5.0 cm) the handrail 108 so as to be out of the way for those who are correctly using the stairs or escalator 102 while ensuring those who are sitting or sliding on the handrail 108 are moved back onto the steps 110. The bottom 124 of the apex 122 is placed sufficiently high above (e.g., 6–8 in. or 15.0–20.5 cm) the handrail 108 that people are able to naturally hold onto the handrail 108 without having to adjust their hand grip.

Figure 3:
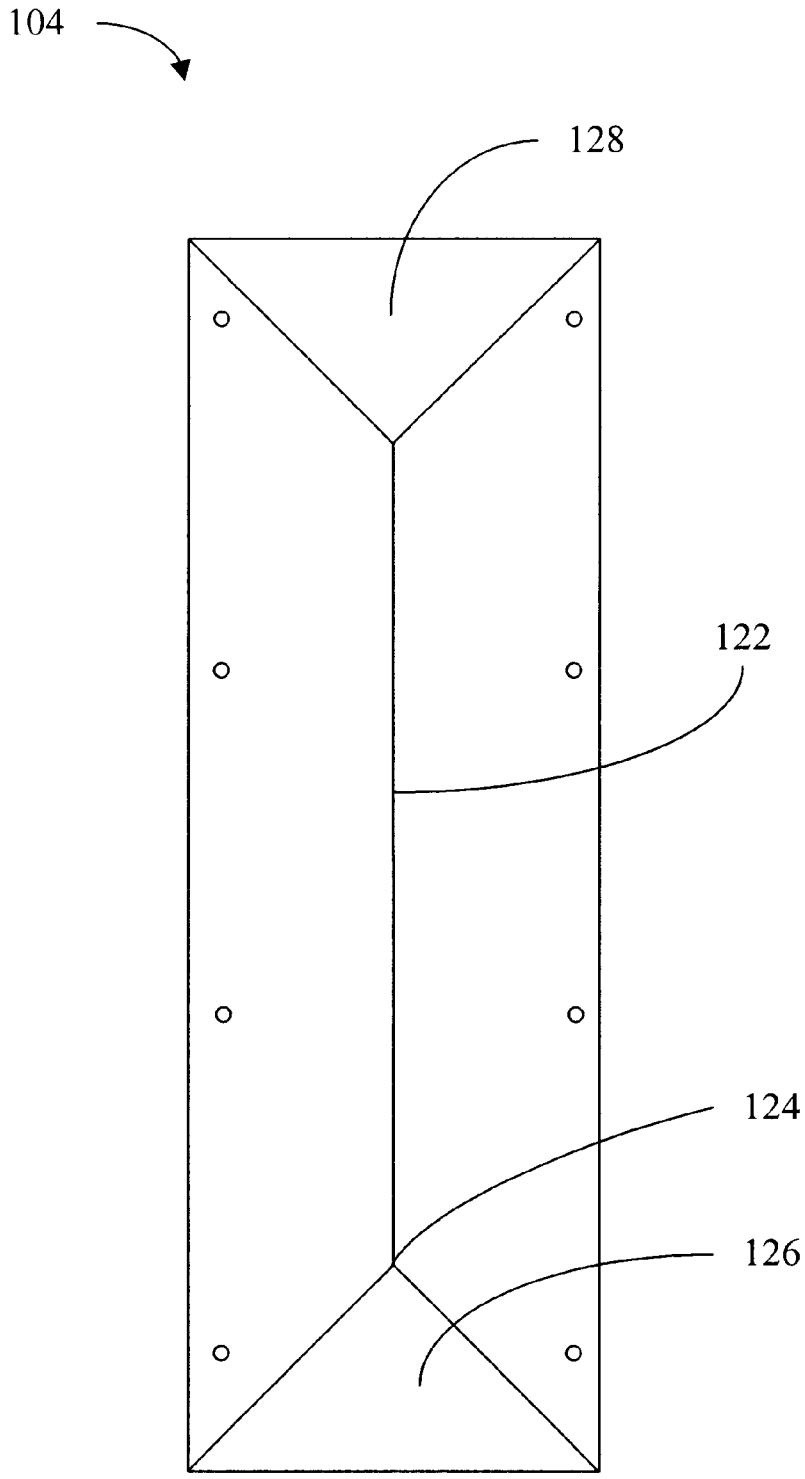
FIG. 3 is a side view of a safety device according to an exemplary embodiment of the present invention.

FIG. 3 is a side view of a safety device 104 according to an exemplary embodiment of the present invention. The safety device 104 is sloped on all four of its sides so as to form an elongated pyramid. The functional surface or surfaces of the safety device 104 that will gently move or bump people back onto the steps 110 should be sufficiently steep to force the individual back onto the steps 110 rather than just sliding over or around the safety device 104 but not so steep that people are in danger of getting hurt by running into or getting trapped by the safety device 104. A slope of about 30° to about 45° is well suited to achieve this result with 45° being preferred because it minimizes the size of the safety device 104. Flat and uniform surfaces are preferred for the functional surfaces of the safety device 104 of FIG. 3 although surfaces with multiple slopes, curves and the like may also be used. Surface configurations that will catch on people's clothing, purse straps and the like should be avoided. A top surface 126 and a bottom 128 of the safety device 104 are also selected are similarly selected to avoid catching on people clothing, purse straps and the like. However, the top and bottom surfaces 126, 128 are not constrained to any particular slopes since the top and bottom surfaces do not function to move people back onto the steps 110.

The safety device 104 can also function bi-directionally if the surface on either side of the apex 122 is properly selected. Although aesthetics will generally require symmetric configurations in unidirectional safety devices 104, the surface not used to move people back onto the steps 110 can have almost any slope and can also have a different shape.

The safety device 104 can be made any material having high strength and relatively low coefficient of friction. Suitable materials include stainless steel, heavy gauge fiberglass, and the like. If a light translucent or transparent plastic is used, the safety device 104 can also function as a light source. If the safety devices are unidirectional, a source of light could be placed on or in the surface that does not gentle move or bump people back onto the steps 110.

Figure 4:
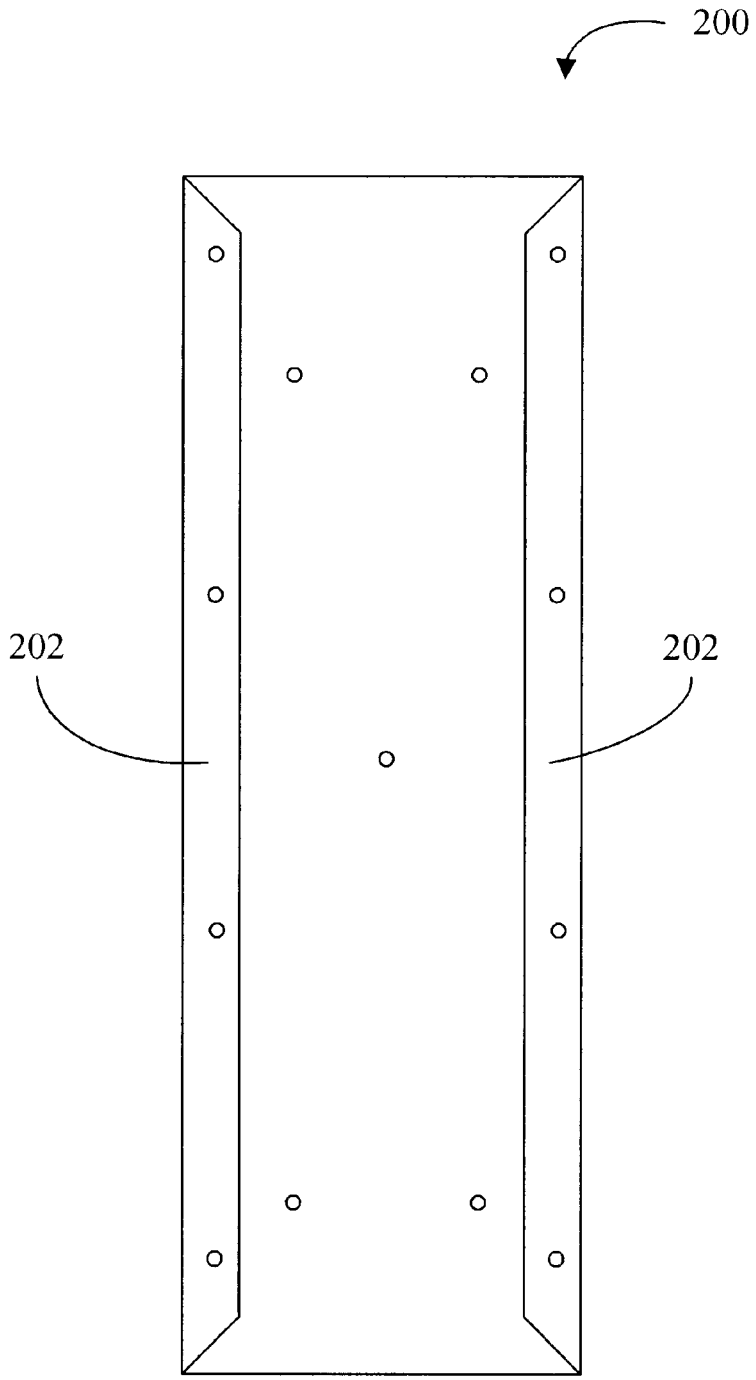
FIG. 4 illustrates a wall connector for the safety device of FIG. 3.

FIG. 4 illustrates a wall connector 200 for the safety device 104 of FIG. 3. The wall connector 200 is attached to the wall 106 using know techniques such as bolts, screws and the like. Extended portions 202 of the wall connector

200 can then be used to secure the safety device 104 with rivets. However, no particular method of connection is required to practice the invention.

The dimensions of the present invention may vary depending upon the constraints of the environment or location it is to be located. For example, the space between the wall and the handrail 104 and wall height.

A exemplary safety device 104 might have the following specifications: 21" long, 7" wide elongated pyramid with generally flat surfaces having a 45° slope and made from 22 gauge stainless steel that has been welded and ground smooth, and attached to a wall connector 200 with rivets.

The present invention can also be used in other contexts such as moving walkways and the like. Multiple safety devices 104 may be used to increase the proper usage of stairs or escalators.

Although several embodiments of the present invention and its advantages have been described in detail, it should be understood that changes, substitutions, transformations, modifications, variations, permutations and alterations may be made therein without departing from the teachings of the present invention, the spirit and the scope of the invention being set forth by the appended claims.

I claim:

1. A method of improving a person's safety comprising:

locating a sloped surface in a fixed position and vertically higher than a handrail;

wherein the sloped surface has an angle capable of moving a person toward the handrail; and wherein the sloped surface is one side of an elongated pyramid.

2. The method of claim 1, wherein the angle is between about 30° and about 45° from the direction of the handrail.

3. The method of claim 2, wherein the angle is 45°.

4. The method of claim 1, further comprising illumining the sloped surface.

5. The method of claim 4, wherein the sloped surface is capable of transmitting light.

6. The method of claim 1, wherein the sloped surface is within about two feet of an end to the support.

7. The method of claim 1, wherein the sloped surface is part of a structure without sharp edges.

8. A safety device comprising:

a sloped surface located in a fixed position and vertically higher than a handrail;

wherein the sloped surface is at an angle capable of moving a person toward the handrail; and wherein the sloped surface is one side of an elongated pyramid.

9. The safety device of claim 8, wherein the angle is between about 30° and about 45° from the direction of the handrail.

10. The safety device of claim 8, wherein the angle is 45°.

11. The safety device of claim 8, further comprising illumining the sloped surface.

12. The safety device of claim 11, wherein the sloped surface is capable of transmitting light.

13. The safety device of claim 8, wherein the sloped surface is within about two feet of an end to a support.

14. The safety device claim 8, wherein the sloped surface is part of a structure without sharp edges.

15. A method of improving a person's safety comprising:

locating an elongated pyramid having a sloped surface vertically higher than a handrail such that a vertical projection of the sloped surface is between a support and the handrail;

wherein the sloped surface is at an angle between about 30 and about 45 from the direction of the handrail.

16. The method of claim 15, wherein the elongated pyramid is self-illumining.

17. A safety device comprising:

an elongated pyramid including a sloped surface;

wherein the elongated pyramid is vertically higher than a handrail such that a vertical projection of the sloped surface is between a support and the handrail;

wherein the sloped surface is at an angle between about 30° and about 45° from the direction of the handrail.

18. The safety device of claim 17, wherein the elongated pyramid is self-illumining.

* * * * *